US005792544A

United States Patent [19]

Klein

[11] Patent Number: 5,792,544

[45] Date of Patent: Aug. 11, 1998

[54] FLEXIBLE ABRASIVE ARTICLE AND METHOD FOR MAKING THE SAME

[75] Inventor: Douglas G. Klein, Windsor, Vt.

[73] Assignee: Eastwind Lapidary, Inc., Windsor, Vt.

[21] Appl. No.: 745,714

[22] Filed: Nov. 12, 1996

[51] Int. Cl.[6] ..... B24D 11/00

[52] U.S. Cl. ..... 428/143; 428/148; 51/309; 51/295; 427/180; 427/203; 427/191; 427/205; 427/372.2

[58] Field of Search ..... 428/143, 148; 51/309, 295; 427/180, 203, 191, 205, 372.2

[56] References Cited

U.S. PATENT DOCUMENTS

| | | | |
|---|---|---|---|
| 3,899,307 | 8/1975 | Thompson | 51/298 |
| 3,916,584 | 11/1975 | Howard et al. | 51/308 |
| 4,256,467 | 3/1981 | Gorsuch | 51/295 |
| 4,381,188 | 4/1983 | Waizer et al. | 51/298 |
| 4,381,925 | 5/1983 | Colleselli | 51/298 |
| 4,466,218 | 8/1984 | Ottman et al. | 51/395 |
| 4,553,982 | 11/1985 | Korbel et al. | 51/298 |
| 5,049,165 | 9/1991 | Tselesin | 51/295 |
| 5,116,392 | 5/1992 | Selgrad et al. | 51/309 |
| 5,247,765 | 9/1993 | Quintana | 51/309 |
| 5,389,119 | 2/1995 | Ferronato et al. | 51/296 |
| 5,451,446 | 9/1995 | Kincaid et al. | 428/143 |
| B1 5,049,165 | 9/1995 | Tselesin | 51/295 |

*Primary Examiner*—William P. Watkins, III
*Attorney, Agent, or Firm*—Michael J. Weins

[57] ABSTRACT

The present invention relates to a flexible abrasive article for grinding or polishing and a method for making the same. The flexible abrasive article has a fabric substrate and at least one abrasive layer provided thereon. The abrasive layer is a composite with an adhesive binder in which diamond particles and metal particles are distributed to form an interpenetrating array of diamond particles and metal particles. It is preferred that the metal particles be about equal to or coarser than the size of the diamond particles. It is still further preferred that the abrasive layer include a distribution of non-metallic filler particles interspersed with the diamond particles and the metal particles. The method of making the flexible abrasive article described above can be accomplished by selecting a fabric substrate, preparing an abrasive coating mixture by first mixing a resin with a volatile carrier, second mixing in the particulate components, and applying the mixture to the substrate in one or more layers.

28 Claims, 3 Drawing Sheets

FLEXIBLE ABRASIVE ARTICLE AND METHOD FOR MAKING THE SAME

FIELD OF THE INVENTION

The present invention relates to flexible abrasive articles and, in particular, to fabric belts and disks for wet grinding and polishing having an abrasive layer thereon with diamond particles distributed therethrough.

BACKGROUND OF THE INVENTION

For the grinding and polishing of hard materials, such as gemstones, abrasive articles incorporating diamond particles have been found to be highly effective in increasing the abrasion rate, and in some applications are required for their cutting power. However, if the cutting power is not essential, diamonds are frequently not included in abrasive articles. This is because the expense of diamond particles, compared to other abrasive particles, requires the diamond abrasive article to provide a longer service life in order to be cost effective when compared with abrasive articles employing less expensive abrasive particles, such as silicon carbide. The service life is the amount of work which the abrasive article will do before it wears out. The amount of work will be determined by both the cutting rate of the abrasive article and the number of hours in use which the article will last, with these two parameters typically being inversely proportional. Frequently, diamond abrasive articles do not provide service lives of sufficient length to make them cost effective.

Classically, resin-bonded composite grinding wheels which have diamond particles as the abrasive particles have included metal particles to enhance the strength of the wheel, thereby extending the life of the abrasive article. The use of metal particles in resin-bonded wheels is more fully discussed in U.S. Pat. No. 3,899,307. However, it has been found that the addition of metal particles increased the hardness of the composition, thereby increasing the chance of glazing of the wheel, reducing its effectiveness. The '307 patent teaches the incorporation of an oxide material in addition to the metal, thereby softening the composition and allowing the diamonds to be released in a timely manner before they become dull.

Alternatively, as taught in U.S. Pat. Nos. 4,381,188 and 4,381,925, various inert filler materials may be added to the composition to reduce the amount (and cost) of resin required, and to provide increased strength to the adhesive composition. The addition of fillers in the '188 and '925 patents is taught for wheels which are molded articles, and thus are not suited for applications where a flexible surface is desired. The resulting molded wheels would not be well suited for polishing and grinding contoured surfaces.

U.S. Pat. No. 5,049,165 suggests an alternative structure for forming abrasive surfaces which are more flexible. A carrier is provided, having cells into which diamond particles can be placed. A matrix material is provided for maintaining the diamond particles in the cells of the carrier. The carrier may be either metal or a plastic material, while the matrix material is either a sintered metal or an adhesive into which the diamonds are embedded. The cellular carrier, when made of metal, may also provide the matrix when sintered. The resulting articles provide a degree of flexibility; while apparently not suitable for abrasive belts per se, the articles may be employed as abrasive pads bonded to a flexible belt substrate. Additionally, the fabrication techniques of such articles are complicated.

Fabric substrates of either woven or matted materials have been used as a substrate for grinding and polishing belts and disks which provide flexible grinding surfaces. Typical belts are described in U.S. Pat. Nos. 4,553,982 and 5,451,446. Classically, such abrasive articles employ an adhesive, such as a phenolic resin, to hold abrasive particles onto the fabric substrate. Typically, such belts and disks have been fabricated by the steps of: a) depositing a make coat of resin onto the fabric substrate, b) dispersing diamond particles onto the make coat, c) curing the make coat, d) depositing a size coat onto the surface, and e) curing the size coat. The disadvantage of such flexible grinding and polishing surfaces is the rapid degradation of the abrasive surface with use. This limit to the useful life of the abrasive surface is especially disadvantageous where expensive abrasive particles, such as diamonds, are used. Additionally, it has been difficult to incorporate fine abrasive particles into such surfaces.

To overcome this latter limitation, U.S. Pat. No. 3,916,584 teaches the incorporation of fine diamond particles (in the range from 0.5 to 25 microns) into spheroidal composite particles. These composite particles are applied to a fabric substrate in the manner described above for larger diamonds, thus providing a three-dimensional array of diamond particles.

Thus, while there have been a variety of solid grinding wheels that have developed excellent grinding capacity and life expectancy, there has been no similar advance in the technology of flexible, cloth-backed grinding surfaces. Thus, there is a need for an effective resin-bonded abrasive suitable for deposition onto a fabric substrate, forming a flexible abrasive article which will provide increased useful life.

SUMMARY OF THE INVENTION

The present invention relates to a flexible abrasive article for grinding or polishing hard non-metallic substances, such as quartz, spinel, sapphire, and ceramics, and a method for making the same.

The flexible abrasive article, in its elementary form, has a fabric belt or disk serving as a substrate and at least one abrasive layer provided thereon. The abrasive layer is a composite with an adhesive binder, which is preferably an epoxy resin, a phenolic resin, or mixture thereof, in which diamond particles and metal particles are distributed to form an interpenetrating array of diamond particles and metal particles.

Preferably, the metal particles are metals or metal alloys which, in either case, contain one or more metals selected from the group of metals consisting of antimony, tin, lead, zinc, copper, nickel, and iron. The alloys would include, for example, elemental metals as well as alloys such as brasses, bronzes, and solders. It is also preferred that the metal particles be about equal to or coarser than the size of the diamond particles. It is further preferred that the ratio of metal to diamond content on a weight basis be maintained such that the metal content is greater than about 39% of the diamond content, with an upper limit on the percentage of metal particles in the abrasive layer of about 39% by weight. It is further preferred that the ratio of the metal to diamond content be maintained at less than about 355%.

It is also preferred for the abrasive layer to have a diamond content of between about 11% and 36% by weight. It is further preferred for the adhesive binder to constitute more than about 17.5% by weight of the abrasive layer.

It is still further preferred that the abrasive layer also include a distribution of non-metallic filler particles interspersed with the diamond particles and the metal particles. The non-metallic filler particles serve as a filler and strengthener, and are typically a soft compound such as $CaCO_3$ or talc, with $CaCO_3$ being preferred. The addition of filler particles should be limited such that the metal particles and the filler particles, in combination, will be between about 41% and 66% of the total weight of the abrasive layer.

For grinding applications, it is preferred that size of the diamond particles be maintained at a size selected to be between about 60 mesh and 400 mesh, in which case it is preferred that the metallic particles be slightly coarser than the diamond particles (between 50 mesh and 325 mesh, the size depending on the diamond particle size), that the metal particles melt at a relatively high temperature (in excess of 1000° F. (538° C.)). It is further preferred that the metal particles are metal or metal alloys containing one or more metals selected from the group of metals consisting essentially of copper, nickel, and iron.

It is further preferred for such size ranges that about 10% to 33% by weight of secondary metal particles be included as part of the metal powder. The secondary metal particles preferably are selected to have a lower melting point (below 800° F. (427° C.)). The secondary metal particles are preferably metals or metal alloys containing one or more metals selected from the group of metals consisting essentially of antimony, tin, lead, and zinc, and have a particle size smaller than that of the diamond particles.

Additionally, when diamond particles having a particle size greater than 45 microns (larger than 400 mesh) are employed, it is preferred to use metal-clad diamond particles to provide a better bond with the adhesive. Nickel-clad diamond particles are preferred for improved bonding with the adhesive, and are available commercially through distributors such as Kay Industries. Such particles are typically clad with metal equal to 30%–60% of the weight of the diamond particle, this additional metal increasing the effective size of the diamond particles. This extra metal weight is ignored when determining the total metal content and total diamond content of the abrasive layer. Because the metal-clad diamond particles have a greater size, the size of the metal particles employed in the abrasive layer will preferably be increased so that they are maintained at a size which is equal to or greater than the size of the metal-clad diamond particles.

For initial polishing applications, the particle size of the diamond particles should be relatively fine, preferably less than 45 microns (–400 mesh). More preferably, the diamond particles will be a size in the range from 15 microns to 45 microns (about 400 to 1200 mesh) for initial polishing, and it is further preferred for friable diamond particles to be employed.

When the diamond particle size is reduced below about 45 microns (–400 mesh), it is preferred to employ low melting point metal particles which are preferably metals or metal alloys containing one or more metals selected from the group of metals consisting of antimony, tin, lead, and zinc. It is also preferred for the metal particles to have a size of about –325 mesh. Because such low melting point metals and alloys are soft compared to the diamond particles, the relative size of the metal particles compared to the diamond particles is not critical. The metal will wear much faster than the diamond. However, it is still advantageous for the metal particles to be at least about as coarse as the diamond particles in order to provide a distribution which forms interpenetrating arrays of diamond and metal particles to provide a support network structure for the abrasive layer.

For fine polishing, monocrystalline diamond particles are preferred, with particle sizes less than about 15 microns (sizes less than 1200 mesh).

For all size ranges of diamond and metal particles, when filler particles are included, the size of the filler particles is not critical. However, it is preferred that the filler particle size be maintained about –150 mesh, with the particles passing through a 150 mesh sieve.

While the ranges of the components as described above are felt to provide a significant improvement in cutting performance while maintaining or improving the useful life of the abrasive article, it is further preferred, particularly in the finer diamond particle sizes, to employ narrower ranges of the components for best performance. More preferably, the diamond content will be maintained between about 16.5% and 28.5%, with the ratio of metal to diamond on a weight basis being maintained between about 91% and 168%. One particularly preferred composition for the abrasive layer is a combination of about 22% by weight diamond particles, 27.5% by weight metal particles, 23% by weight adhesive resin, and 27.5% by weight filler particles, thus having a metal to diamond ratio of about 125% on a weight basis.

The method of making the flexible abrasive article described above can be accomplished by the following procedure.

A fabric substrate is selected. The substrate is preferably a cotton or a polyester-cotton blend fabric, which can be a matted material or a woven material. A woven material is preferred since it will provide greater strength in tension.

The fabric substrate is preferably coated with a waterproofing sizing coat. A phenolic melamine applied to the substrate on the opposite side to that on which the abrasive layer is to be applied can serve as the sizing coat. Fabric substrates are commercially available which are already pre-coated, thus allowing the fabrication of the flexible abrasive article to be started with a pre-coated fabric. Suitable fabrics are available through commercial suppliers such as Wellington Sears.

An abrasive coating mixture is prepared for applying to the fabric substrate. Although the order of addition of the components of the abrasive coating mixture is not critical, it is generally preferred to prepare the abrasive coating mixture in a two-step process. In the first step, the liquid components are mixed together. An epoxy resin and/or a phenolic resin is mixed with a volatile carrier such as alcohol. When a phenolic resin is employed, it is preferred that the dissolved solid content of the phenolic resin be between about 65–80% by weight.

When a two-step mixing process is employed, the particulate components are added after the liquid components have been mixed. Diamond particles and metal particles are added to the mixture of liquid components and blended until a homogeneous abrasive coating mixture is formed. Again, although such a two-step mixing procedure is preferred, the order of mixing together the components is not felt to be essential to practicing the method of the present invention, and the liquid and particulate components could be combined in one step.

The resulting coating mixture is then applied to the pre-coated substrate in one or more layers. It is preferred to maintain the thickness of each layer of the coating mixture to less than about ⅛ to ¼ mm, to avoid blistering of the surface during evaporation of the volatile carrier. It should be noted that thicker layers could be employed, but such would require longer drying times to avoid blistering, thereby slowing the fabrication process.

It is further preferred that an addition of filler particles be provided to the coating mixture. When the two-step mixing procedure described above is used, the filler particles are introduced with the diamond and metal particles and mixed into the liquid components.

BEST MODE OF CARRYING THE INVENTION INTO PRACTICE

Figure 1:
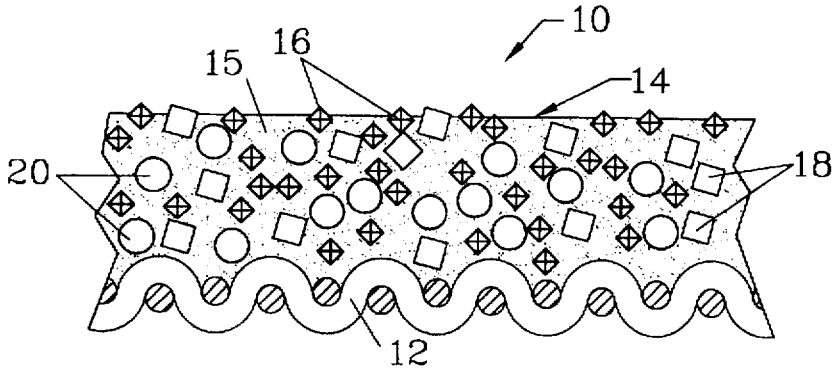
FIG. 1 is an illustration of a section of a fabric-backed belt or disc which forms one embodiment of a flexible abrasive article of the present invention which is well suited for polishing applications. In this embodiment, a fabric substrate has a single abrasive layer applied thereto. The abrasive layer has several components which include an adhesive binder, fine diamond particles, metal particles which are slightly coarser than the diamond particles, and filler particles.

FIG. 1 is an illustration of a section of a flexible abrasive article 10 of the present invention which is well suited for polishing applications. In this embodiment, a woven fabric belt or disk serves as a fabric substrate 12 onto which an abrasive layer 14 is applied. The fabric substrate 12, illustrated, is a woven cotton or cotton/poly fabric and is pre-coated with a waterproofing sizing coat, such as phenolic melamine, applied to the side of the belt or disk opposite to the side on which the abrasive layer 14 is applied. Such fabric substrates are available commercially, from such sources as Wellington Sears. Woven fabric substrates are preferred for having greater strength in tension than non-woven fabrics.

The abrasive layer 14 is a composite containing an adhesive binder 15 which has distributed therethrough an array of fine diamond particles 16 and an interpenetrating array of metal particles 18. The adhesive binder 15 preferably is an adhesive resin and preferably constitutes more than about 17.5% by weight of the abrasive layer 14. The adhesive binder 15 bonds the array of diamond particles 16 and the array of metal particles 18 together, as well as bonding them to the fabric substrate 12. The array of fine diamond particles 16 distributed in the abrasive layer 14 provides the cutting and polishing power of the abrasive layer 14.

To maintain the cutting power of the abrasive layer 14, it is preferred that the diamond particles 16 be maintained between about 11% and 36% by weight of the abrasive layer 14. For initial polishing applications, it is preferred that the size of the diamond particles 16 be maintained at less than about 45 microns so that the particles will pass through a 400 mesh sieve.

The array of metal particles 18 which form an interpenetrating array with the array of diamond particles 16 are felt to be in large part responsible for the superior performance of the flexible abrasive article of the present invention. Preferably, the weight of the metal particles 18 is maintained at less than about 39% of the total weight of the abrasive layer 14, and is maintained between 39% and 355% of the weight of the diamond particles 16. For such ranges of metal content, the abrasive layer will, after being used to grind a gemstone, develop a burnished surface with a metallic luster.

For initial polishing applications, where the size of the diamond particles 16 is less than 45 microns (less than 400 mesh), it is preferred for the metal particles 18 to be selected from metals and metal alloys which melt at relatively low temperatures, such as tin or zinc. The metal particles 18 employed in the flexible abrasive article 10 are generally larger than the diamond particles 16, and for diamond particles which are about 400 mesh, the metal particles 18 will be about 325 mesh. When the metal particles 18 melt at relatively low temperatures, they are relatively soft, therefore the size of the metal particles 18 relative to the size of the diamond particles 16 is not critical, as any oversize metal particles 18 will readily be reduced by wear and expose the diamond particles 16. The metal particles 18 are felt to provide a surface having better thermoconductivity to enhance the heat transfer by a liquid coolant when in use, and additionally provide a lubricant to reduce heating due to friction.

The abrasive layer 14 of the embodiment illustrated in FIG. 1 also contains filler particles 20 distributed throughout the abrasive layer 14. The filler particles 20 and the metal particles 18, in combination, are preferably maintained at between about 41% and 66% by weight of the abrasive layer 14. The filler particles 20 are preferably a compound, and $CaCO_3$ is a preferred compound for the filler particles 20. The particle size of the filler particles 20 is not critical, but should be sufficiently large to provide structural support for the abrasive layer 14. The filler particles 20 reduce the amount of adhesive binder 15 needed, contribute to the strength of the surface, and provide structure for the abrasive layer 14. Preferably the size of the filler particles 20 will be about −150 mesh.

While the abrasive layer 14 may employ a classical adhesive binder material such as a phenolic resin or an epoxy resin for the matrix, it is preferred that the adhesive binder 15 be a mixture of a phenolic resin and an epoxy resin, wherein the ratio of the epoxy resin to the phenolic resin is between about 20% and 128%, and more preferably, about 40% by weight. For determining this ratio, the weight of the epoxy and its corresponding hardener is counted as the epoxy weight. Preferred phenolic resins are those which are alcohol soluble, and it is further preferred to use a phenolic formaldehyde resin having a 65%–80% by weight dissolved solid content, such as OxyChem® brand. Similarly, preferred epoxy resins are those that are alcohol soluble, and it is further preferred to employ a two-part, slow curing, high strength epoxy such as Devcon® Two Ton brand.

Figure 2:
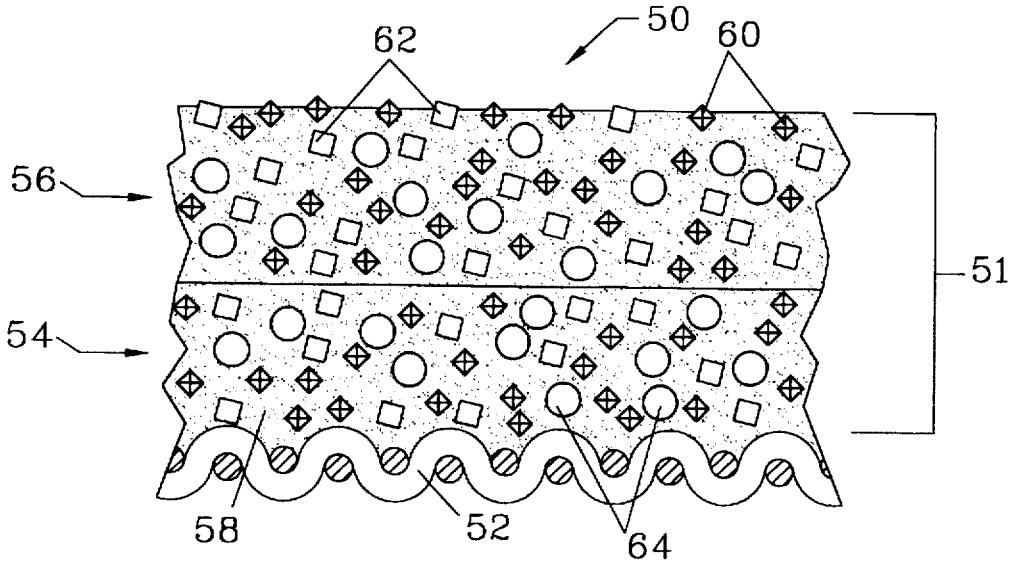
FIG. 2 illustrates a section of fabric-backed belt or disc which forms another embodiment of the flexible abrasive article of the present invention. In this embodiment, two abrasive layers, each similar to the single abrasive layer of the embodiment of FIG. 1, have been applied to a fabric substrate to increase the overall thickness of the abrasive residing on the fabric substrate, while assuring curing of each of the abrasive layers without bubbling.

FIG. 2 illustrates a section of a flexible abrasive article 50 of a preferred embodiment of the present invention which is similar in composition to the embodiment of FIG. 1, and again is designed for polishing. The flexible abrasive article 50 of this embodiment differs in that it has a multiple layer abrasive coating 51. The flexible abrasive article 50 employs a belt or disk of woven fabric which serves as a substrate 52 onto which the multiple layer abrasive coating 51 is deposited. The multiple layers of the abrasive coating 51 facilitate increasing the thickness of the abrasive coating 51 which can be applied to the substrate 52 without blistering, which would degrade the quality of the resulting flexible abrasive article 50. A first abrasive layer 54 is applied to the fabric substrate 52 and a second abrasive layer 56 is applied to the first abrasive layer 54. Both first and second abrasive layers (54 and 56) contain an adhesive binder 58, which is preferably an adhesive resin and preferably constitutes more than about 17.5% by weight of each of the abrasive layers (54 and 56).

Since the flexible abrasive article 50 is designed for use for polishing, diamond particles 60 in the first and the second abrasive layers (54 and 56) are maintained at a size less than 400 mesh. For sizes between 400 mesh and 1200 mesh, it is preferred for the diamond particles 60 to be friable particles, which increases their cutting rate, while for sizes less than 1200 mesh, it is preferred to employ monocrystalline particles to enhance the fine polishing quality of the resulting abrasive surface.

The first and second abrasive layers (54 and 56) also contain metal particles 62, with percentage by weight of the metal particles 62 in the abrasive layers (54 and 56) preferably being maintained below about 39%, and the weight ratio of metal particles 62 to diamond particles 60 being maintained between 39% and 355%. Again, the metal particles 62 are selected from metals and metal alloys which melt at relatively low temperatures, such as zinc or tin, and the metal particles 62 are preferably comparable in size to or larger than the diamond particles 60.

Again, the first and second abrasive layers (54 and 56) each contain filler particles 64 of a compound, preferably $CaCO_3$. The quantity of the filler particles 64 is adjusted such that the combined weight of the filler particles 64 and the metal particles 62 constitutes 41% to 66% by weight of each of the first and second abrasive layers (54 and 56).

Figure 3:
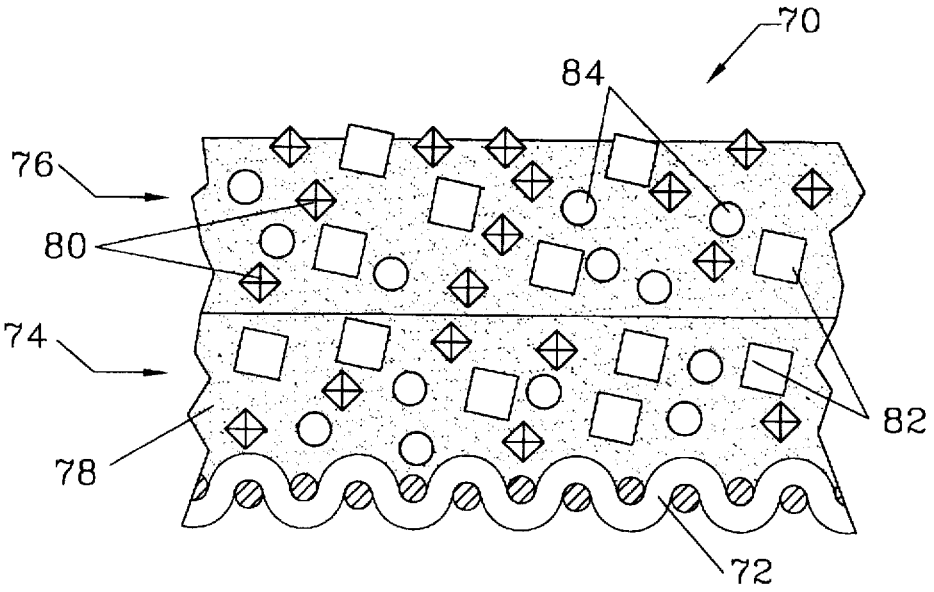
FIG. 3 illustrates a section of a belt or disc which forms another embodiment of a flexible abrasive article of the present invention. The section of the belt or disc is similar to the embodiment shown in FIG. 2; however, this embodiment employs coarser diamond particles than the diamond particles employed in the embodiments shown in FIGS. 1 and 2. The belt or disk of this embodiment is suitable for grinding applications.

FIG. 3 illustrates a section of a flexible abrasive article 70 of another embodiment of the present invention, which is well suited for grinding applications. The flexible abrasive article 70 shares many common features with the embodiment of FIG. 2. The flexible abrasive article 70 again has a woven fabric belt or disc substrate 72. A first abrasive layer 74 is applied to the substrate 72, and a second abrasive layer 76 is in turn applied to the first abrasive layer 74. Both the first and second abrasive layers (74 and 76) contain an adhesive binder 78 as well as diamond particles 80 and metal particles 82. Again, it is preferred for the adhesive binder 78 to be an adhesive resin and, more preferably, to be maintained greater than about 17.5% by weight of the abrasive layers (74 and 76).

However, in this embodiment, the diamond particles 80 are coarser than the diamond particles of the embodiments of FIGS. 1 and 2. The diamond particles 80 are maintained at a size in the range between about 60 mesh and 400 mesh. Again, it is preferred that the diamond particles 80 constitute 11% to 36% by weight of each of the abrasive layers (74 and 76) to maintain cutting power.

Similar to the embodiment of FIG. 2, the metal particles 82 preferably are maintained at less than about 39% of the weight of each of the abrasive layers (74 and 76), and the ratio by weight of the metal particles 82 to the diamond particles 80 is preferably maintained between about 39% and 355% by weight. In this embodiment, the metal particles 82 are also coarser, and again have a particle size slightly larger than the size of the diamond particles 80. The metal particles 82 are preferably a high melting point metal such as copper, iron, or nickel.

Again, filler particles 84, which are preferably $CaCO_3$, form part of the first and second abrasive layers (74 and 76). These filler particles 84 preferably have a particle size of about −150 mesh. As with the embodiments discussed above, the amount of the filler particles 84 is preferably adjusted such that the combined weight of the filler particles 84 and the metal particles 82 constitutes 41% to 66% by weight of each of the first and second abrasive layers (74 and 76).

Figure 4:
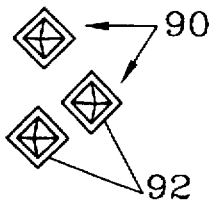
FIG. 4 illustrates coarse diamond particles which are metal-clad to improve adhesion with an adhesive binder and to increase the ability to dissipate heat generated by grinding with the diamond particles. Such metal-clad diamond particles are suitable for use in place of the coarse diamond particles employed by the embodiment of FIG. 3.

FIG. 4 illustrates alternative coarse diamond particles 90, which could be substituted for the diamond particles 80 of the embodiment illustrated in FIG. 3. The diamond particles 90 are provided with a metal cladding 92. Preferably, the metal cladding 92 is nickel and increases the weight of the diamond particles 90 by about 30 to 60%. This extra metal weight is ignored when calculating the total percentage of metal in the abrasive layers (74 and 76), and is subtracted from the weight of the diamond particles 90 when calculating the total percentage of diamond in the abrasive layers (74 and 76). One commercial supplier of such metal-clad diamond particles is Kay Industries. While metal-clad diamond particles 90 are more expensive to employ, the use of metal-clad diamond particles 90 is felt to provide better holding power of the metal-clad diamond particles 90 in the abrasive layer (74 or 76) and provide better heat transfer of the heat generated by cutting. These benefits obtained by using the metal-clad diamond particles 90 result in a longer useful life for the belt or disk. It should be noted that when metal-clad diamond particles 90 are employed, the effective size of the diamond particles 90 will be increased by the metal cladding 92, and the size of metal particles 82 employed should be increased a corresponding amount to ensure that the metal particles 82 are still equal to or larger than the effective size of the diamond particles 90.

Figure 5:
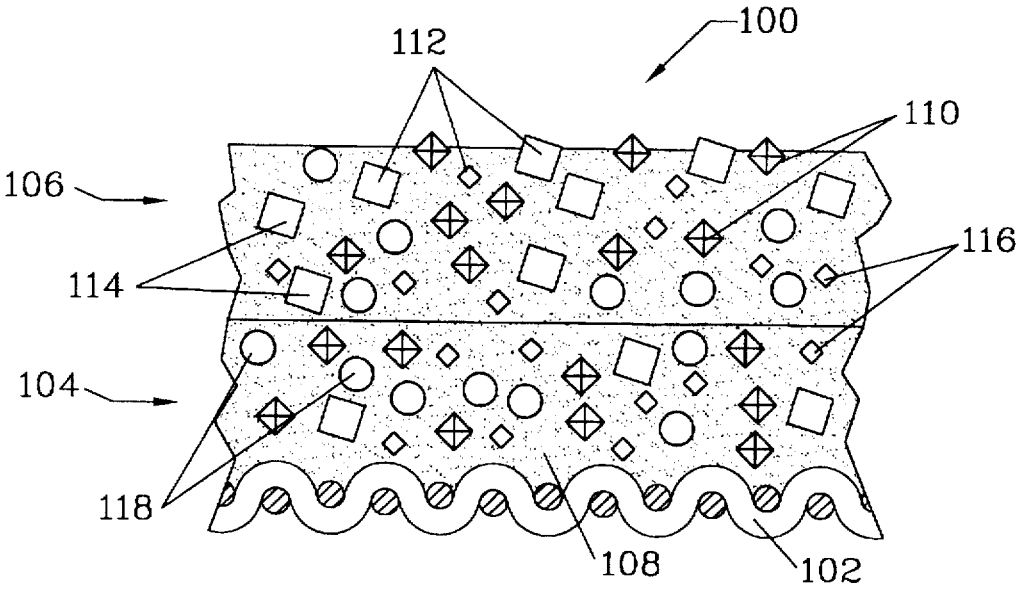
FIG. 5 illustrates a section of a belt or disc which forms another embodiment of a flexible abrasive article of the present invention. Coarse diamond particles are employed, similar to the diamond particles of the embodiment of FIG. 3; however, in the embodiment of FIG. 5, two sizes of metal particles are employed. Primary metal particles are employed, which are slightly larger than the diamond particles and which are selected to have relatively high melting temperatures. Typically, these particles are iron-based and serve as the principal metal particles. Secondary metal particles are also employed. Typically, these secondary metal particles are metals or alloys having relatively low melting temperatures, such as tin or zinc. The secondary metal particles have a particle size smaller than the diamond particle size.

FIG. 5 illustrates a section of a flexible abrasive article 100 of another embodiment of the present invention, which is similar to the embodiment of FIG. 3 and is again well suited for grinding applications. The flexible abrasive article 100 has a woven fabric substrate 102. Again, a first abrasive layer 104 is applied to the woven fabric substrate 102, and a second abrasive layer 106 is applied onto the first abrasive layer 104.

The first and second abrasive layers (104 and 106) each contain an adhesive binder 108 and diamond particles 110, the diamond particles 110 being a size in the range between about 60 mesh and 400 mesh, making the flexible abrasive article 100 suitable for grinding applications. The diamond particles 110 could be metal-clad diamond particles such as the metal clad diamond particles 90 shown in FIG. 4. Such metal-clad particles will provide better adhesion with the adhesive binder 108, as well as better heat sinking for dissipating the heat generated by the diamond particles 110 as they cut.

This embodiment differs from the embodiment of FIG. 3 in that the metal particles 112 consist of a mixture of primary metal particles 114, which are coarse and represent the major portion of the metal particles 112, and secondary metal particles 116, which are fine. The primary metal particles 114 have a particle size slightly larger than the size of the diamond particles 110, and are preferably selected from metals and metal alloys which melt at a relatively high temperature, such as iron, nickel, and copper. The secondary metal particles 116 are preferably selected from metals and metal alloys which melt at relatively low temperatures, such as zinc, tin, lead and antimony. The secondary metal particles 116 are preferably somewhat smaller in size than the diamond particles 110. It is further preferred that the metal particles 112 be composed of about 10% to 33% by weight of the secondary metal particles 116, the remainder being the primary metal particles 114.

Again, the first and second abrasive layers (104 and 106) each contain filler particles 118, which preferably have a particle size of about 150 mesh, and are $CaCO_3$ particles. The amount of the filler particles 118 is again preferably adjusted such that the combined weight of the filler particles 118 and the metal particles 112 constitutes 41% to 66% by weight of each of the first and second abrasive layers (104 and 106).

Figure 6:
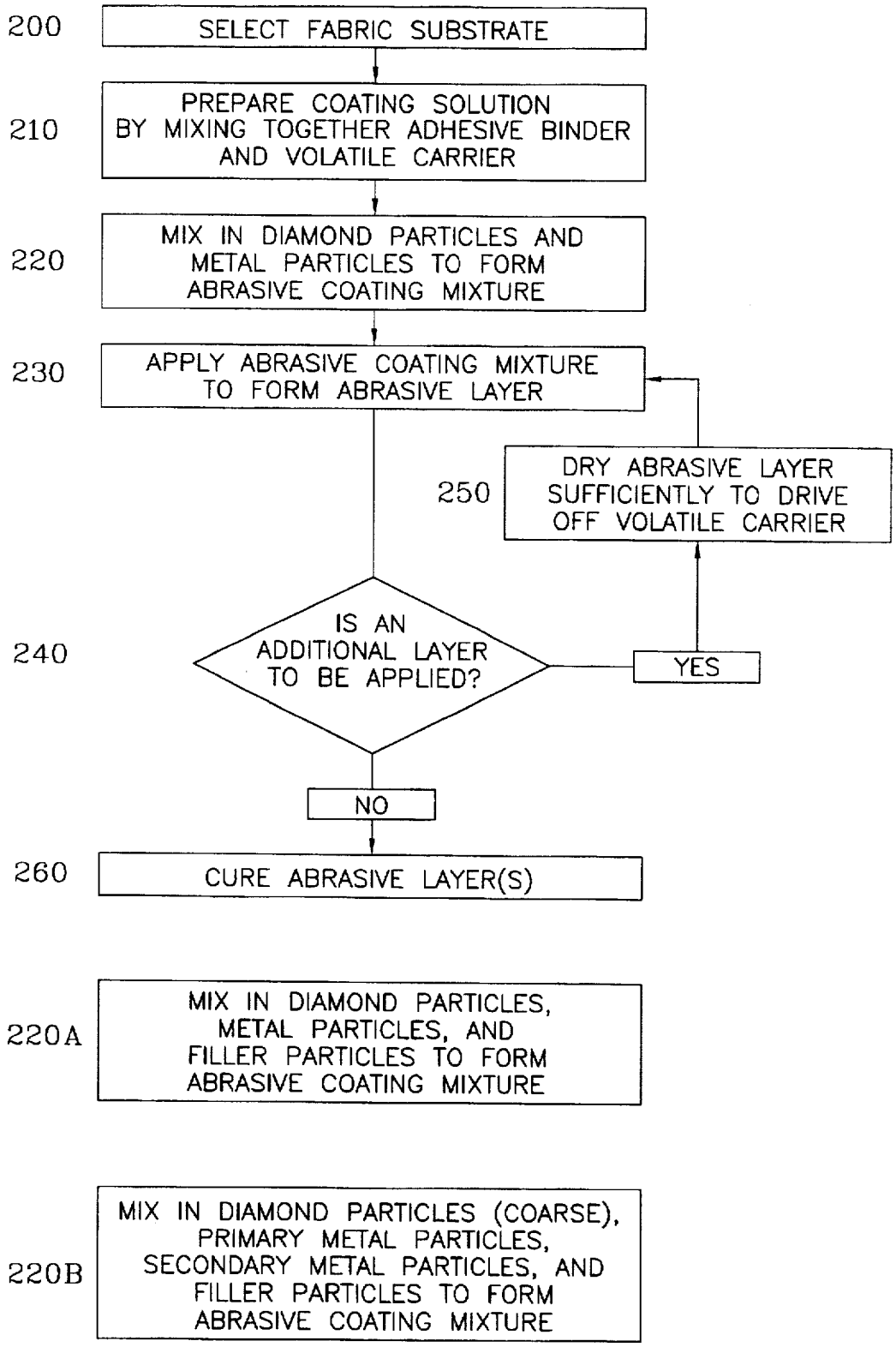
FIG. 6 is a flow diagram illustrating a preferred method of practicing the present invention. The diagram includes two alternative steps: one for fabricating the flexible abrasive article of the embodiments of FIGS. 1 through 3; and another for fabricating the flexible abrasive article of the embodiment of FIG. 5.

Flexible abrasive articles, in accordance with the present invention, may readily be fabricated by a method such as is illustrated in the flow chart of FIG. 6. The method of fabrication of different embodiments, including those illustrated in FIGS. 1, 2, 3, and 5, is substantially similar, differing in the components employed and the number of abrasive layers applied. A basic method for fabricating a flexible abrasive article includes the following steps:

The method is initiated with step 200, selecting a fabric substrate, which is preferably a cotton or a polyester-cotton blend fabric. The substrate can be a matted material or a woven material; a woven material being preferred for greater strength. It is preferred to use a fabric substrate which is pre-coated with a waterproofing sizing coat. A phenolic melamine applied to the substrate on the opposite side to that on which the abrasive layers are to be applied can serve as the sizing coat. Such a fabric substrate, already pre-coated, is commercially available though suppliers such as Wellington Sears. In the event that the fabric substrate is not pre-coated, an additional step of pre-coating the substrate could be added to the method.

Following the selection of a substrate 200, a coating solution is prepared 210 by mixing together an adhesive binder and a volatile carrier such as alcohol. Typically, a sonicator will be employed for mixing the coating solution. The adhesive binder may be an epoxy resin or a phenolic resin; however, as discussed above, it is preferred for the preparation 210 of the coating solution to include mixing together an epoxy resin and a phenolic resin, where the ratio of the epoxy resin (including a corresponding hardener) to the phenolic resin is 20% to 128% by weight, and more preferably about 40%. It is preferred that the dissolved solid content of the phenolic resin be between about 65–80% by weight.

Diamond particles and metal particles are added 220 to the above coating solution and blended until a homogeneous abrasive coating mixture is formed. When the diamond particles and metal particles are well mixed, they should be evenly distributed throughout the abrasive coating mixture, forming interpenetrating arrays. Again, a sonicator will typically be used for mixing. Preferably, the metal content of the mixture will be maintained at less than about 39% by weight, and the diamond content will be maintained between about 11 and 36% by weight. Furthermore, the metal content will preferably be maintained at least 39% of the diamond content and less than about 355% of the diamond content on a weight basis. It has also been found preferable to maintain the percentage of adhesive binder in the coating mixture greater than about 17.5%. For calculating all weight percentages, the weight of the volatile carrier in the abrasive coating mixture is ignored.

It should be noted that steps 210 and 220 could be combined into a single step, in which case all components of the abrasive coating mixture are combined together, and the order of their addition has generally been found not to be critical.

At least a portion of the resulting abrasive coating mixture is then applied 230 to the fabric substrate to provide a first abrasive layer. The first abrasive layer applied to the fabric substrate is preferably maintained at a thickness of between about ⅛ and ¼ mm. Such a thickness will allow the volatile carrier to be driven off without blistering the surface of the abrasive layer. The first abrasive layer can be applied by a brush, using a measured amount of the abrasive coating mixture and painting the mixture onto the substrate until the measured amount has been applied. For preferred mixtures such as described above, an amount of about 0.1201 g per square inch has been found to result in an abrasive layer which falls within the preferred range.

A determination 240 must be made as to whether or not an additional layer is to be added. If an additional layer is to be added, to form an abrasive article having an abrasive coating of greater thickness, then the method proceeds to step 250.

After the application of the most recently applied abrasive layer, the belt or disk is dried 250. The drying step 250 is at a relatively low temperature for a sufficient time to drive off the volatile carrier and to partially cure the adhesive binder of the most recently applied abrasive layer. For a volatile carrier such as alcohol, a temperature between 93° and 118° C. (200°–250° F.) and a drying time of between 20 and 30 minutes have been found to be sufficient for drying the abrasive layer.

After drying 250, an additional abrasive layer is provided by returning to the application step 230, and another layer of the coating mixture is applied over the previously-applied abrasive layer. The additional abrasive layer again preferably has a thickness of about ⅛–¼ mm, being of substantially the same thickness as the first abrasive layer. The additional abrasive layer may also be readily applied by brushing on a measured amount of the abrasive coating mixture.

After the application of each layer, a determination 240 must be made as to whether an additional layer is to be added. While additional abrasive layers will provide an abrasive coating on the substrate of greater thickness, they will also increase the brittleness of the flexible abrasive articles. For abrasive belts, which are subjected to considerable flexing while in use, it has been found that two abrasive layers are a practical maximum. Disks are less subject to flexing when in use, and additional layers may be added. However, there again is a practical maximum, as too many layers will result in an article which is too brittle to achieve the desired flexibility of the present invention. Lack of sufficient flexibility will make the abrasive disk poorly suited to grinding and polishing contours.

After the application of all the desired abrasive layers, the flexible abrasive article is cured at a high temperature 260 for a sufficient time to cure the adhesive binder. If the adhesive binder is a mixture of epoxy and phenolic resins as discussed above, curing at a temperature between about 149° and 157° C. (300°–315° F.) for between 5 and 6 hours has been found to be sufficient. Cotton or cotton/poly fabrics are preferred for the fabric substrate, since they can withstand such curing temperatures. The resulting abrasive belt or disk is relatively waterproof and suitable for use for wet grinding or polishing.

While the above described method is felt to sufficiently fabricate a flexible abrasive article according to the present invention, alternative methods are required for fabricating the preferred embodiments as illustrated in FIGS. 1 through 3 and as illustrated in FIG. 5, and described in detail above.

Alternative step 220A is substituted for step 220 when fabricating embodiments such as illustrated in FIGS. 1 through 3. In step 220A, diamond particles and metal particles are mixed into the coating solution, as in step 220. However, in alternative step 220A, filler particles are also added and mixed in. Again, it should be noted that step 210 and step 220A could be combined into a single step.

The filler particles added are preferably of a relatively inert substance, such as $CaCO_3$ or talc. When such filler particles are added, it is preferred that the amount of filler particles be such that the combined total weight of the metal particles and the filler particles be between about 41% and 66% of the weight of the total abrasive coating mixture.

In a further preferred method, the diamond content will be between about 16.5% and 28.5% by weight, with the weight ratio of metal to diamond being maintained between 91% and 168%.

Similarly, alternative step 220B is substituted for step 220 when fabricating an embodiment such as the preferred embodiment illustrated in FIG. 5. In alternative step 220B, diamond particles (coarse), primary metal particles, secondary metal particles, and filler particles are all added to the coating solution to form the abrasive coating mixture. Yet again, it should be noted that step 210 and step 220A could be combined into a single step.

When both primary and secondary metal particles are employed, it is preferred for the combined weight of the primary metal particles and secondary metal particles to be less than about 39% by weight of the abrasive mixture, and further preferred for their combined weight to be maintained at least 39% of the diamond content and less than about 355% of the diamond content on a weight basis. Typically, the primary metal particles have a particle size slightly larger than the size of the diamond particles, and are preferably a high melting point metal such as iron. The secondary metal particles are preferably of a low melting point metal such as zinc or tin, and are typically somewhat smaller in size than the diamond particles.

Again, it is preferred that the amount of filler particles be such that the combined total weight of the primary and secondary metal particles and the filler particles be between about 41% and 66% of the weight of the total abrasive coating mixture.

EXAMPLES

While the invention can be practiced employing a broad range of compositions, there are particular compositions which are preferred. Through extensive experimentation with random mixtures, a formulation was developed which has been found to be particularly effective. This formulation contains by weight 23% resin, 22% diamond, 27.5% metal and 27.5% $CaCO_3$, with the resin being a mixture of a phenolic resin and an epoxy resin, wherein the ratio of the epoxy resin to the phenolic resin is about 40% by weight. This formulation is effective for both coarse and fine diamond particles. In order to demonstrate its effectiveness and how the properties of the resulting flexible abrasive surface are affected by variations in composition, the following samples were prepared and tested.

The formulations indicated in the tables were prepared and applied to 1.5 inch wide×6 inch diameter woven fabric belt substrates, each having a surface area of 28.2743 square inches, following the fabrication method described above to form belts with two abrasive layers applied thereto. In all examples, the adhesive binder consisted of a mixture of epoxy and phenolic resins, where the ratio of epoxy to phenolic was 40% by weight, and the filler particles consisted of 150 mesh particles of $CaCO_3$.

All belts were tested by employing them on a belt drive which provided a belt speed of 2700 ft./min., against which samples having a cross section sufficient to provide contact area with the belt of about ¼ square inch were hand held with a moderate force of 3–5 lbs.

Tables 1–3 represent a series of samples where the metal and diamond levels were changed while the resin and $CaCO_3$ were maintained constant. The variation between the tables results from the particle sizes used to formulate the belts.

The belts of Table 1 employed 120 mesh friable diamond particles as the abrasive and 80 mesh (−80 mesh, all particles less than 80 mesh with most of them in the range of 80 mesh) iron particles were employed as the metal particles. The diamond particles of Examples 2–5 were nickel-clad, with the added nickel equaling 30% by weight of the diamond particles. The belts were tested by grinding a ¼ inch plate glass workpiece for 15 seconds and recording weight loss.

As can be seen from the results, Example 1, which is outside the invention, failed and caused fracturing of the workpiece, thus no weight loss of the workpiece could be measured. The remaining samples were effective in grinding the workpiece without fracturing it. However, at a diamond content of less than about 11%, the removal rate was slow, and at 36% diamond, some chipping of the workpiece was noted.

Thus, the preferred range of diamond content in the abrasive layers is greater than about 11% and less than 36% by weight, and where the weight ratio of metal to diamond is greater than about 39% and less than about 355%

A more preferred diamond range would have a preferred upper limit which is greater than 22% diamond and less than 36% diamond, and have a preferred lower limit which is less than 22% diamond and greater than 11% diamond, with the metal to diamond ratio corresponding.

The belts reported in Tables 2 and 3, while having the same proportions by weight of the components as the belts of Table 1, differ in the size of the diamond particles and in the composition and size of the metal particles. For the samples of Tables 2 and 3, the metal particles were tin and the size was 325 mesh (–325 mesh, all particles less than 325 mesh with most of them in the range of 325 mesh). The belts of Table 2 had a diamond particle size of 9 microns (1800 mesh), and monocrystalline diamond particles were employed, while the diamond particle size for the belts of Table 3 was 15 microns (1200 mesh), and friable diamond crystals were employed.

The belts were tested for their polishing capacity as described above; however, the workpieces for these tests were tourmaline which had been ground with a 120 mesh diamond belt of the present invention. The workpiece was then polished on the test belt for 10 seconds and visually observed.

Referring to Table 2, where the diamond particles were the finest size, there is confirmation that the most effective compositions have less than 36% diamond and more than 11%.

Referring to Table 3, where the diamond particles were 15 microns, the data indicates that the effectiveness of the different compositions for polishing is similar to the findings in Table 2. However, it would appear that belts with higher diamond content, approaching 36%, may be more suitable for the belts employing coarser diamond particles, where the somewhat degraded performance is less critical.

Tables 4 and 5 represent belts that were similar to those of Table 3, but differ in the ratios of the components employed. These examples again employed friable 15 micron diamond particles. The examples of Table 4 maintained the relative ratios of the resin to metal to carbonate constant at the ratios of Example 23 in Table 3. Reviewing the results, the preferred composition in this situation would have a diamond particle concentration of greater than 11% and less than 33%. The data also support a more preferred range for the diamond particle concentration of between about 17.5% and 28.5% by weight.

Table 5 shows the results for another series of belts, where the metal/diamond ratio was kept constant and the resin to carbonate ratio was kept constant, both ratios being maintained at the ratios of Example 23. These examples again indicate a preferred diamond content greater than 11%. At 33%, the polished finish was bright, but the belt showed excessive wear. This is felt to indicate that the resin level must be maintained above about 11.5%, to avoid extensive belt wear, and preferably above 17.5% to avoid dislodging of the diamond particles. The results again indicate a more preferred diamond range, in this case from 16.5% to 27.5% diamond.

From reviewing the results of Tables 4 and 5, it appears that a more preferred range of diamond concentration would be between about 16.5% and 28.5% diamond.

Comparison to Prior Art Products

Tables 6 through 8 compare the performance of the present invention with that of prior art flexible abrasive surfaces. In all cases, the abrasive surfaces of the present invention were made with the particularly preferred composition where the weight proportion of the components was 23% resin, 22% diamond particles, 27.5% metal particles, and 27.5% $CaCO_3$ filler particles.

Table 6 shows the results of a test to compare the grinding performance of prior art diamond abrasive belts (3M® Imperial® brand cabbing belt) and belts of the present invention. All belts were used to wet grind plate glass workpieces. A comparative test between the prior art and the present invention was conducted for belts having 100 mesh diamond particles and 220 mesh diamond particles as the abrasive. When a glass workpiece was firmly pressed against the 3M® belts, such resulted in the glass workpiece spalling for both the 3M® belts. A force of about 5–7 lbs. was applied to the work pieces, which had a cross-section of about ½ to ¾ square inches. The spalling was presumably due to overheating. When a similar glass workpiece was pressed with similar force against the belt of the present invention, the glass was abraded without shattering or spalling for both the 100 mesh and the 220 mesh belts. The pressure was approximately doubled, and in both belts the glass work piece maintained its integrity, demonstrating that the present invention will allow for more aggressive grinding without concern of damaging the workpiece.

Table 7 shows the results of tests to compare the polishing performance and speed of prior art abrasive surfaces and abrasive surfaces of the present invention for belts employing 15 micron diamond particles as the abrasive. The workpieces for the tests had been previously ground with a belt employing 120 mesh diamond particles as an abrasive. These workpieces were polished to compare the ability to remove the scratches and leave a bright, glossy surface. Both tourmaline and beryl workpieces were employed, with similar results for both minerals. After 10 seconds a belt of the present invention resulted in a bright, glossy finish without scratches. A 3M® Imperial® brand diamond cloth belt was found to provide a semi-gloss finish with noticeable scratches after 10 seconds, and a slightly dull finish without scratches after 30 seconds. A Rayteck True Circle belt was found to result in a dull, scratchy finish after 10 seconds and a dull finish after 30 seconds. These results indicate that the present invention has a greater polishing ability, allowing an acceptable finish to quickly be obtained.

To measure abrading power, similar tourmaline workpieces, which had an initial surface polished with a 15 micron abrasive, were polished for 60 seconds, and the amount of weight removed from the workpieces was measured. The belt of the present invention removed 0.40 carats, while the 3M® belt removed 0.06 carats, and the Rayteck belt removed 0.09 carats. This indicates that the belt of the present invention had an effective cutting speed almost 7 times faster than the 3M® product, and over 4 times faster than the Rayteck product. This increased abrading power enhances the removal of scratches resulting from previous polishing steps.

Increased abrading power not only enhances the removal of scratches, but also increases the overall usefulness of the belt. The belts of the present invention have been found to have a useful lifetime equal to or longer than prior art belts. Assuming belt lifetimes to be equal, an increase in cutting speed of 4 times or 7 times will result in a corresponding increase in the amount of work that can be achieved with the belt in the course of its life. Such increased usefulness is particularly important for articles which employ diamond particles as the abrasive, due to the expense of diamonds.

Table 8 provides comparative results of a test of the polishing performance of prior art abrasive surfaces and abrasive surfaces of the present invention which employed 6 micron diamond particles as the abrasive. In the case of the present invention, monocrystalline diamond particles were employed. Tourmaline workpieces which had been abraded by a 120 mesh size abrasive were polished for 10 seconds to compare the ability to remove the scratches and leave a bright, glossy surface. A 3M® Imperial® brand cabbing belt was found to result in a satin finish with noticeable scratches, while a belt of the present invention left a bright, glossy finish with minimal scratches. The test was extended on the 3M® belt until the scratches had been removed (30–40 seconds), the extended polishing still resulting in a satin finish.

Table 1 compares the performance of examples 1 through 5 of belts made with abrasive layers having the compositions indicated.

TABLE 1

| Example | 1 | 2 | 3 | 4 | 5 |
|---|---|---|---|---|---|
| Resin | 1.5625 | 1.5625 | 1.5625 | 1.5625 | 1.5625 |
| Diamond | 3.3967 | 2.4456 | 1.4945 | 0.7473 | 0.4076 |
| Metal | 0.0 | 0.9511 | 1.9021 | 2.6494 | 2.9891 |
| $CaCO_3$ | 1.8342 | 1.8342 | 1.8342 | 1.8342 | 1.8342 |
| (all masses in grams) | | | | | |
| Resin | 23% | 23% | 23% | 23% | 23% |
| Diamond | 50% | 36% | 22% | 11% | 6% |
| Metal | 0% | 14% | 28% | 39% | 44% |
| $CaCO_3$ | 27% | 27% | 27% | 27% | 27% |
| Metal/ Diamond | 0% | 39% | 127% | 355% | 733% |
| Glass Work piece | breaks | chips | no chips | no chips | no chips |
| Cutting Speed | — | 2.2 | 3.51 | 1.59 | 0.66 |

(Weight loss (ct) of work piece after 15 seconds)

Table 2 compares the performance of examples 6 through 10 of belts made with abrasive layers having the compositions indicated.

TABLE 2

| Example | 6 | 7 | 8 | 9 | 10 |
|---|---|---|---|---|---|
| Resin | 1.5625 | 1.5625 | 1.5625 | 1.5625 | 1.5625 |
| Diamond | 3.3967 | 2.4456 | 1.4945 | 0.7473 | 0.4076 |
| Metal | 0.0 | 0.9511 | 1.9021 | 2.6494 | 2.9891 |
| $CaCO_3$ | 1.8342 | 1.8342 | 1.8342 | 1.8342 | 1.8342 |
| (all masses in grams) | | | | | |
| Resin | 23% | 23% | 23% | 23% | 23% |
| Diamond | 50% | 36% | 22% | 11% | 6% |
| Metal | 0% | 14% | 28% | 39% | 44% |
| $CaCO_3$ | 27% | 27% | 27% | 27% | 27% |
| Metal/ Diamond | 0% | 39% | 127% | 355% | 733% |
| Polishing Finish | Dull | Dull | Fine | Dull w/ moderate scratches | Dull w/ deep scratches |

(polishing ability tested on tourmaline with scratches from 120 mesh abrasive, polished for approximately 10 seconds)

Table 3 compares the performance of examples 21 through 25 of belts made with abrasive layers having the compositions indicated.

TABLE 3

| Example | 21 | 22 | 23 | 24 | 25 |
|---|---|---|---|---|---|
| Resin | 1.5625 | 1.5625 | 1.5625 | 1.5625 | 1.5625 |
| Diamond | 3.3967 | 2.4456 | 1.4945 | 0.7473 | 0.4076 |
| Metal | 0.0 | 0.9511 | 1.9021 | 2.6494 | 2.9891 |
| $CaCO_3$ | 1.8342 | 1.8342 | 1.8342 | 1.8342 | 1.8342 |
| (all masses in grams) | | | | | |
| Resin | 23% | 23% | 23% | 23% | 23% |
| Diamond | 50% | 36% | 22% | 11% | 6% |
| Metal | 0% | 14% | 28% | 39% | 44% |
| $CaCO_3$ | 27% | 27% | 27% | 27% | 27% |
| Metal/ Diamond | 0% | 39% | 127% | 355% | 733% |

TABLE 3-continued

| Example | 21 | 22 | 23 | 24 | 25 |
|---|---|---|---|---|---|
| Polishing Finish | Dull w/ scratches (belt wear substantial) | Satin w/ light scratches | Bright w/slight scratches | Deep scratches (low cutting rate) | Very dull w/deep scratches |

(polishing ability tested on tourmaline with scratches from 120 mesh abrasive, polished for approximately 10 seconds)

Table 4 compares the performance of examples 16 through 20 of belts made with abrasive layers having the compositions indicated.

TABLE 4

| Example | 16 | 17 | 18 | 19 | 20 |
|---|---|---|---|---|---|
| Resin | 1.8682 | 1.8002 | 1.6644 | 1.4266 | 1.3587 |
| Diamond | 0.4416 | 0.7473 | 1.1888 | 1.9361 | 2.2418 |
| Metal | 2.2758 | 2.1738 | 2.0040 | 1.7662 | 1.6304 |
| $CaCO_3$ | 2.2078 | 2.0720 | 1.9361 | 1.6640 | 1.5624 |
| (all masses in grams) | | | | | |
| Resin | 27.5% | 26.5% | 24.5% | 21% | 20% |
| Diamond | 6.5% | 11% | 17.5% | 28.5% | 33% |
| Metal | 33.5% | 32% | 29.5% | 26% | 24% |
| $CaCO_3$ | 32.5% | 30.5% | 28.5% | 24.5% | 23% |
| Metal/ Diamond | 515% | 291% | 168% | 91% | 73% |
| Polishing Finish | Dull w/ deep scratches | Dull w/ deep scratches | Semi-gloss w/ light scratches | Satin w/ medium scratches | Dull w/ medium scratches |

(polishing ability tested on tourmaline with scratches from 120 mesh abrasive, polished for approximately 10 seconds)

Table 5 compares the performance of examples 11 through 15 of belts made with abrasive layers having the compositions indicated.

TABLE 5

| Example | 11 | 12 | 13 | 14 | 15 |
|---|---|---|---|---|---|
| Resin | 2.7513 | 2.3437 | 1.9700 | 1.1888 | 0.7812 |
| Diamond | 0.3736 | 0.7473 | 1.1209 | 1.8682 | 2.2418 |
| Metal | 0.4755 | 0.9511 | 1.4266 | 2.3776 | 2.8532 |
| $CaCO_3$ | 3.1928 | 2.7513 | 2.2758 | 1.3587 | 0.9171 |
| (all masses in grams) | | | | | |
| Resin | 40.5% | 34.5% | 29% | 17.5% | 11.5% |
| Diamond | 5.5% | 11% | 16.5% | 27.5% | 33% |
| Metal | 7% | 14% | 21% | 35% | 42% |
| $CaCO_3$ | 47% | 40.5% | 33.5% | 20% | 13.5% |
| Metal/ Diamond | 127% | 127% | 127% | 127% | 127% |
| Polishing Finish | Dull w/ minor deep scratches | Dull w/ minor deep scratches | Satin w/ moderate/ scratches | Bright w/deep scratches | Bright (visible belt wear) |

(polishing ability tested on tourmaline with scratches from 120 mesh abrasive, polished for approximately 10 seconds)

Tables 6, 7, and 8 compare the performance of flexible abrasive surfaces of the present invention and commercially available flexible abrasive surfaces having a comparable diamond particle size. All abrasive surfaces of the present invention were made with the following proportions of components:

Resin—23%
Diamond—22%
Metal—27.5%
$CaCO_3$—27.5%

TABLE 6

| | Present Invention | 3-M ® Imperial ® Brand Cabbing Belt |
|---|---|---|
| Diamond Size: | 100 mesh | |
| Cutting: | Class uniformly abraded | Glass shatters |
| Diamond Sie: | 220 mesh | |
| Cutting: | Glass uniformly abraded | Class shatters |

(glass workpiece pressed firmly against belt)
(quartz workpiece appeared to be ground faster with Present Invention than with 3-M ® product)

TABLE 7

| | Diamond Size: 15 micron (1200 mesh) | | |
|---|---|---|---|
| | Present Invention | 3-M ® Imperial ® Diamond Cloth | Rayteck Corp. True-Circle |
| | Tourmaline Workpiece | | |
| Polishing Finish: (10 sec) | Bright, glossy finish w/ slight scratches | Semi-gloss w/ noticeable scratches | Dull finish |
| (30 sec): | N/A | Slightly dull without noticeable scratches | Dull finish |
| | Beryl Workpiece | | |
| Polishing Finish (10 sec): | Bright, glossy finish w/ slight scratches | Semi-gloss w/ noticeable scratches | Dull finish |
| (polishing ability tested on workpieces with scratches from 120 mesh abrasive) | | | |
| Weight Removed in 60 sec: | .40 carats | .06 carats | .09 carats |

(Tourmaline workpiece with initial surface polished with 15 micron abrasive)

TABLE 8

| | Diamond Size: 6 micron | |
|---|---|---|
| | Present Invention | 3-M ® Imperial ® Brand Cabbing Belt |
| Polishing Finish: | Bright, glossy finish | Satin finish |

(polishing ability tested on tourmaline with scratches from 120 mesh abrasive, polished for approximately 10 seconds)

What is claimed is:

1. A flexible abrasive article for wet grinding and polishing surfaces comprising:

a fabric substrate;

at least one abrasive layer applied to said substrate and having, an adhesive binder selected from the group consisting essentially of epoxy resins, phenolic resins, and mixtures thereof, metal particles randomly distributed through said at least one abrasive layer, said metal particles being metals or metal alloys containing one or more metals from the group of metals consisting of antimony, tin, zinc, lead, copper, nickel, and iron, and diamond particles randomly distributed through said at least one abrasive layer, wherein said metal particles and said diamond particles are randomly dispersed throughout said at least one abrasive layer such that said diamond particles and said metal particles form interpenetrating arrays of diamond particles and metal particles.

2. The flexible abrasive article of claim 1 wherein said fabric substrate has a waterproof sizing coat applied thereto.

3. The flexible abrasive article of claim 2 wherein said metal particles are about equal to or coarser in size than said diamond particles.

4. The flexible abrasive article of claim 2 wherein said at least one abrasive layer has a metal particle concentration which is less than about 39% by weight of said at least one abrasive layer, and a diamond particle concentration such that said metal particle concentration is greater than about 39% by weight of said diamond particle concentration.

5. The flexible abrasive article of claim 4 wherein said metal particle concentration is less than about 355% by weight of said diamond particle concentration.

6. The flexible abrasive article of claim 5 wherein said diamond particle concentration is between about 11% and 36% by weight of said at least one abrasive layer.

7. The flexible abrasive article of claim 6 wherein said at least one abrasive layer includes interdispersed non-metallic filler particles, the concentration of said non-metallic filler particles being limited such that said metal particles and said filler particles provide a combined concentration of between about 41% and 66% by weight of said at least one abrasive layer.

8. The flexible abrasive article of claim 7 wherein said diamond particles are between 60 mesh and 400 mesh and wherein said metal particles are metal and metal alloys consisting essentially of one or more metals selected from the group of metals consisting of copper, nickel, and iron.

9. The flexible abrasive article of claim 8 further comprising secondary metal particles which are metal or metal alloys containing one or more metals selected from the group of metals consisting of antimony, tin, lead, and zinc, wherein said secondary metal particles provide between about 10% and 33% by weight of the metal concentration, said secondary metal particles being smaller than said diamond particles.

10. The flexible abrasive article of claim 7 wherein said diamond particles have a size between 400 mesh and 1200 mesh, and said metal particles are metal and metal alloys containing one or more metals from the group of metals consisting of antimony, tin, zinc, and lead.

11. The flexible abrasive article of claim 7 wherein said diamond particles are noncrystalline particles having a size smaller than 1200 mesh, and said metal particles are metal and metal alloys containing one or more metals form the group of metals consisting of antimony, tin, zinc, and lead.

12. An improved flexible abrasive article having a fabric substrate, with at least one abrasive layer containing diamond particles deposited thereon, the improvement comprising:

an array of metal particles, said metal particles being metals or metal alloys containing one or more metals from the group of metals consisting of antimony, tin, zinc, lead, copper, nickel, and iron, said metal particles being randomly distributed through the at least one abrasive layer, such that said metal particles and the diamond particles form interpenetrating arrays, whereby the diamond particles are randomly distributed throughout the abrasive layer.

13. The improved flexible abrasive article of claim 12 wherein said metal particles have a particle size which is greater than or equal to the size of the diamond particles.

14. The improved flexible abrasive article of claim 13 wherein the ratio of said metal particles to the diamond particles is greater than about 39% by weight, and wherein the concentration of said metal particles in the at least one abrasive layer is less than about 39% by weight of the at least one abrasive layer.

15. The improved flexible abrasive article of claim 14 wherein the ratio of said metal particles to the diamond particles is less than about 355% by weight.

16. The improved flexible abrasive article of claim 15 wherein the concentration of the diamond particles in the at least one abrasive layer is between about 11% and 36% by weight of the at least one abrasive layer.

17. The improved flexible abrasive article of claim 15 wherein the concentration of the diamond particles in the at least one abrasive layer is further limited to between about 16.5% and 28.5% by weight of the at least one abrasive layer.

18. The improved flexible abrasive article of claim 17 wherein the at least one abrasive layer has a thickness of less than about ¼ mm.

19. The improved flexible abrasive article of claim 18 wherein the diamond particles are a size greater than 400 mesh and wherein said metal particles have a melting temperature of greater than about 1000° F. (538° C.).

20. The improved flexible abrasive article of claim 18 wherein the diamond particles are a size smaller than 400 mesh and wherein said metal particles have a melting temperature of less than about 800° F. (427° C.).

21. A method for fabricating a flexible abrasive article comprising the steps of:

a) selecting a fabric substrate;

b) preparing an abrasive coating mixture by mixing together an adhesive resin binder, a volatile carrier, metal particles, and diamond particles to form said coating mixture, said metal particles being selected from metals or metal alloys containing one or more metals from the group of metals consisting of antimony, tin, zinc, lead, copper, nickel, and iron, said mixing continuing until said diamond particles and said metal particles are randomly distributed throughout said abrasive coating mixture;

c) applying a coat of said coating mixture to one side of said substrate to form an abrasive layer having said metal particles and said diamond particles randomly distributed therethrough; and d) curing said adhesive resin binder, thereby providing an abrasive coating having diamond particles and metal particles randomly distributed therethrough.

22. The method of claim 21 further comprising the steps of:

heating said abrasive layer, after said step of applying a coat, at a temperature sufficient to drive off said volatile carrier; and applying a second coat of said coating mixture over said abrasive layer to form an additional abrasive layer, before said step of curing said adhesive resin binder.

23. The method of claim 22 wherein said metal particles are maintained at less than 39% of the total weight of said coating mixture and further wherein the ratio of said metal particles to said diamond particles is greater than 39% by weight.

24. The method of claim 23 wherein the ratio of said metal particles to said diamond particles is maintained at less than 355% by weight.

25. The method of claim 24 wherein said diamond particles are maintained between about 16.5% and 28.5% of the total weight of said coating mixture.

26. The method of claim 25 wherein said substrate is a pre-coated substrate and wherein said step of preparing a coating mixture further comprises the steps of:

first mixing said adhesive resin binder with said volatile carrier to form a coating solution; and mixing said metal particles, said diamond particles, and filler particles into said coating solution to form said coating mixture, wherein said metal particles and said filler particles have a combined weight of between about 41% and 66% of the total weight of said coating mixture.

27. The method of claim 26 wherein said step of mixing said adhesive resin binder further comprises the steps of:

mixing an epoxy resin with a corresponding amount of a suitable hardener and with said volatile carrier;

mixing said epoxy and said hardener with a phenolic resin mixture in a ratio of epoxy/hardener to phenolic of approximately 40% by weight; and wherein said adhesive resin binder comprises more than about 17.5% of the total weight of said coating mixture.

28. The flexible abrasive article of claim 8 wherein said metal particles are metal particles about equal to or coarser in size than said diamond particles and the flexible abrasive article further comprises:

secondary metal particles which are metal or metal alloys containing one or more metals selected from the group of metals consisting of antimony, tin, lead, and zinc, wherein said secondary metal particles provide between about 10% and 33% by weight of the metal concentration, said secondary metal particles being smaller than said diamond particles.

* * * * *